US006397793B2

(12) United States Patent
Yang et al.

(10) Patent No.: US 6,397,793 B2
(45) Date of Patent: Jun. 4, 2002

(54) MICROCOMBUSTION ENGINE/ GENERATOR

(75) Inventors: Wei Yang, Minnetonka; Ulrich Bonne, Hopkins; Burgess R. Johnson, Minneapolis, all of MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/782,099

(22) Filed: Feb. 13, 2001

Related U.S. Application Data

(62) Division of application No. 09/476,931, filed on Dec. 30, 1999.

(51) Int. Cl.[7] ..... F02B 71/00
(52) U.S. Cl. ..... 123/46 E
(58) Field of Search ..... 123/46 E

(56) References Cited

U.S. PATENT DOCUMENTS

| | | | | |
|---|---|---|---|---|
| 2,966,148 | A | 12/1960 | Jarret et al. | 123/46 |
| 3,234,395 | A | 2/1966 | Colgate | 290/1 |
| 4,154,200 | A | 5/1979 | Jarret et al. | 123/46 R |
| 4,480,599 | A | 11/1984 | Allais | 123/46 R |
| 5,342,176 | A | 8/1994 | Redlich | 417/212 |
| 5,893,343 | A | 4/1999 | Rigazzi | 123/46 E |

OTHER PUBLICATIONS

A Numerical Study of a Free Piston IC Engine Operating on Homogeneous Charge Compression Ignition Combustion, S. Scott Goldsborough and Peter Van Blarigan, Mar. 1–4, 1999.

*Primary Examiner*—Noah P. Kamen
(74) *Attorney, Agent, or Firm*—Kris T. Fredrick

(57) ABSTRACT

A knocking-based, micro-combustion engine constructed in three layers of micromachined material. Two outer layers contain means for directing gases and fuels into and out of vents in a middle layer. The middle layer has machined in it two, linear, free pistons with or without integral air springs, and vents for directing gases and fuels into and out of a combustion chamber. A high compression ratio is achieved. The engine can be constructed with means to generate electrical energy.

29 Claims, 10 Drawing Sheets

MICROCOMBUSTION ENGINE/ GENERATOR

This application is a division of U.S. patent application Ser. No. 09/476,931 filed Dec. 30, 1999, which is incorporated herein by reference.

BACKGROUND

The invention pertains to energy generation. Particularly, it pertains to the generation of energy in small amounts by small devices, and more particularly to microcombustion energy generation.

Batteries have served well as small, portable electric power sources. But they require a relatively long time to recharge or if not recharged, contribute to an increasingly objectionable waste disposal problem. Furthermore they suffer from a low volumetric or mass energy density (compared to that of liquid fuels). Fuel cells may some day overcome the above issues, but presently are either very sensitive to fuel impurities (such as CO in polymer-based fuel cells operating on $H_2$) or require very high operating temperatures, which delay startups and cause shortened service life due to thermal cycling stresses.

The proposed microcombustion engine (MCE) and/or microcombustion generator (MCG) operates three times as long between recharges (requiring less than 1 minute) as a battery of similar volume (e.g., as large as a butane "Bic" lighter), and does not pose a disposal problem when it needs to be replaced. Alternatively it provides fifteen times more heating energy, or output mechanical work when preferred, than a comparable battery.

SUMMARY OF THE INVENTION

The present invention, in part, concerns electrical control of piston synchronization for a microengine having at least two free pistons (pistons with no mechanical linkages). The dimensions of the microengine are typically one millimeter (mm) or less, which is less than the quenching length for combustion in typical fuels. Thus, it is difficult, if not impossible, to initiate combustion with conventional spark plugs. To overcome this difficulty, the microengine operates in a knock mode (i.e., homogeneous auto ignition), where the fuel is compressed to a pressure and temperature high enough to initiate combustion without a spark. In a two-piston microengine, combustion occurs on each cycle where the two pistons meet. Preferably, this is near the center of the engine cylinder, where fuel can be provided and exhaust disposed of efficiently. This requires the motion of the two pistons to be synchronized. If the pistons are not synchronized, the point of combustion will occur away from the center of the microengine, causing the microengine to operate less efficiently, or perhaps cease to operate at all. This invention utilizes electrical methods to synchronize the pistons. In a conventional engine, the pistons are synchronized by mechanical linkages. In a free-piston engine, this is not possible. If the pistons are used to generate electrical power, then the means for generating electrical power can also be used to sense the synchronization error and to apply force to the pistons to correct the synchronization error. Electromagnets are used to sense the positions of the pistons and apply forces to the pistons, in addition to generating electrical power. However, many of the external control circuits are applicable when other types of mechanical to electrical transducers are used, such as piezoelectric or electrostatic transducers.

The basic concept of the proposed engine/generator is to take advantage of the high energy density of available hydrocarbon fuels, which range from 42–53 MJ/kg (11.7–14.7 kWh/kg or 18,000–22,000 Btu/lb.). But rather than be dependent on the proper operation of active/catalytic surfaces in fuel cells, the work potential of combustion engines is harnessed for the conversion from chemical to electrical energy. The main challenge for small, portable systems is to have very small functioning engines that efficiently achieve outputs of ten watts or less.

The features of the present MEMS (i.e., micro electromechanical systems) engine are as follows. It is a linear-free piston engine with complete inertial compensation. The engine is without piston rings, without intake or exhaust valves, and without a carburetor. The engine utilizes "knocking" combustion to overcome wall quenching in combustion chambers smaller than the classical quenching distance. It implements high adiabatic compression ratios within small cylinder and piston geometries.

This engine's features come from three areas. One is the combining an opposed dual piston engine design with the advantageous exhaust gas and fresh gas mixture charge scavenging and inherent inertial compensation. Another is a free piston engine design having gas springs. It uses "knocking" rather than diesel or spark-ignition and an embedded magnet-in-piston, in an engine-generator configuration. The piston size is (square or round cross section) of 0.1–3 mm, and length of 5–14 mm. This system may be fabricated in ceramic or silicon via deep reactive ion etching (DRIE) or other process within a tolerance band of ±2.5 $\mu$m. The top and bottom layers may be composed of sapphire, Pyrex, silicon or other accommodating material. Silicon carbide and metal may also be used in the structure of the engine.

The dual-opposed, free-piston microcombustion engine (MCE) generator has advantages over existing power sources. In contrast to fuel cells, no catalytic films are poisoned by trace constituents such as $SO_2$ or CO, as is the case with (low- and high-temperature) polymer and $ZrO_2$-based fuel cells, whose service life is shortened by thermal cycling; no high-temperatures need to be achieved with the MCE before operation can begin, as with $ZrO_2$ fuel cells. At the same time, the MCE with its assumed 20 percent conversion efficiency is likely to be less efficient than a fuel cell.

The energy density of batteries ($\leqq$1 MJ/kg) is less than ten percent of the 40–50 MJ/kg of hydrocarbon fuels; a "Bic" lighter storing the same volume of liquid butane as a "C" size battery (18 $cm^3$, allowing for a 1 mm-thick container wall) packs 0.58 MJ of combustion energy or 0.12 MJ electrical energy at a conservative twenty percent engine conversion efficiency. This is compared to the 0.039 MJ in a battery for 7.8 Ah at 1.4 V. The present MCG is also easier and quicker to "recharge" in the field by simply refilling the fuel, whereas a battery needs an electrical outlet and time to recharge.

At the same time, the design of this combustion engine was dictated by several considerations. Engines with a crankshaft would either self-destruct within a short time under "knocking" combustion or would not achieve compression-ignition when reduced to MEMS sizes (a piston diameter on the order of 1 mm), and therefore could not be scaled down to such sizes. Related art engines suffer from a much larger piston-to-cylinder sidewall friction, wear (shorter service life) and thus efficiency losses. And by operating under a fixed compression geometry, they are much less flexible in terms of the required fuel properties than free-piston engines.

Knocking occurs when a highly compressed air-fuel mixture in the combustion chamber is compressed rapidly and sufficiently. By compressing the mixture sufficiently fast, heat from this adiabatic event is added to the mixture. The heat from the compression will raise the temperature of the air-fuel mixture enough to ignite itself.

Engines with individual piston chambers cannot as effectively flush out exhaust gases and charge a fresh combustible mixture because their exhaust and intake ports have to be attached to one piston cylinder, rather than situated between two opposed pistons sharing a common combustion chamber.

DESCRIPTION OF THE EMBODIMENTS

Figure 1:
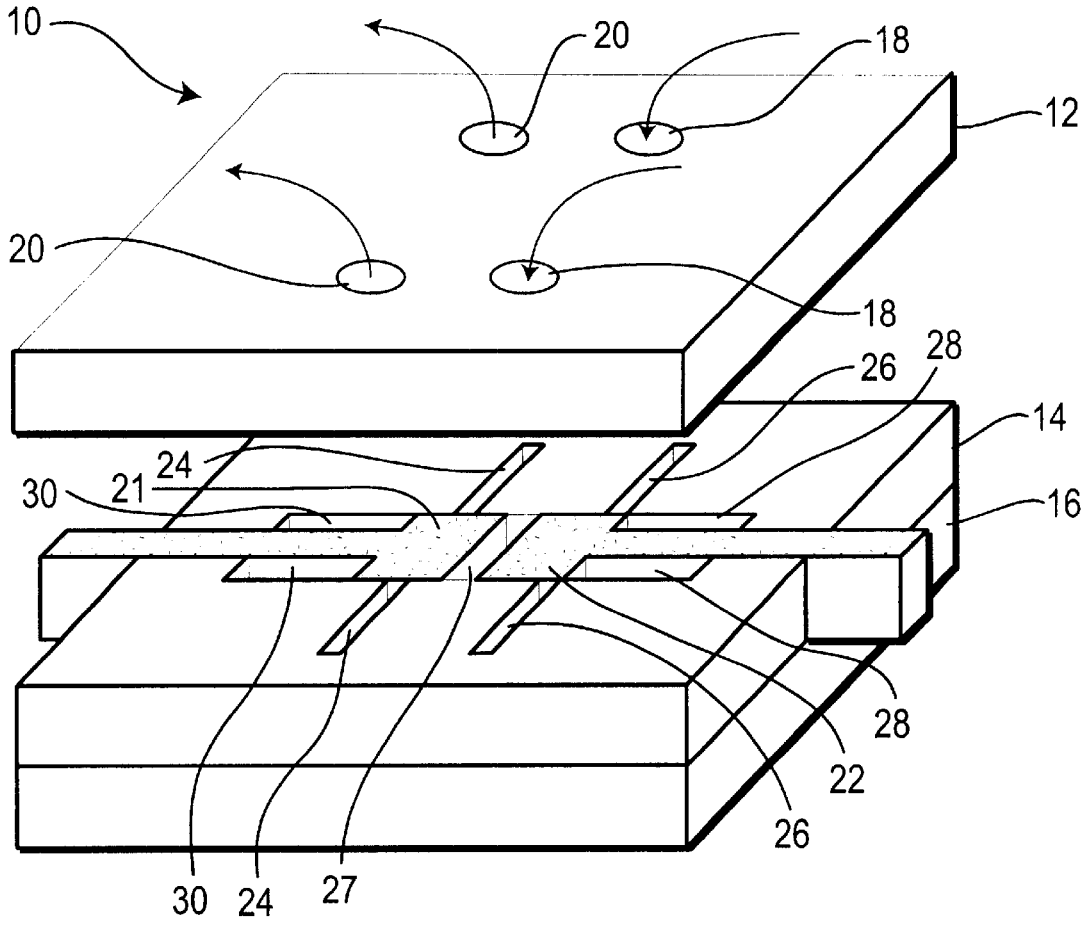
FIG. 1 is an expanded diagram of the microcombustion engine.

An MCE 10 is primarily constructed of three layers of material 12, 14 and 16, respectively, as shown in FIG. 1. Middle layer 14 is typically silicon. The other two layers 12 and 14 could be sapphire or Pyrex. Outer layers 12 and 16 are the same and serve to confine combustion of the fuel and to provide ports 18 and 20 for gas exchange. The linear and free pistons 21, 22 are contained in layer 14 as well as gas exchange vents 24 and 26 and the combustion chamber 27. Also in the middle layer 14 are regions 28 and 30 acting to restore the piston positions following fuel combustion in chamber 27. Regions 28 and 30 against pistons 22 and 21, respectively, function as air springs.

A mixture of fuel and gases enter the combustion chamber 27, while the pistons 21 and 22 are near their maximum separation, through ports 18 in the top 12 and bottom 16 layers and through vents 26 in middle layer 14. As this mixture enters chamber 27, gases from the previous combustion leave chamber 27 through vents 24 in middle layer 14 and then out through ports 20 in the top 12 and bottom 16 layers. As this exchange is progressing, compression of air in regions 28 and 30 in the middle layer 14 acts on pistons 22 and 21. These "air springs" force pistons 21 and 22 to return to their previous positions, causing gas exchange to stop and combustion to occur again. The exchange of gases, being carefully timed, is completed when pistons 21 and 22 have sealed vents 24 and 26 from combustion chamber 27. Further compression in chamber 27 produces an adiabatic reaction, causing the mixture of fuel and gases to ignite, starting the process over again.

Figure 2A:
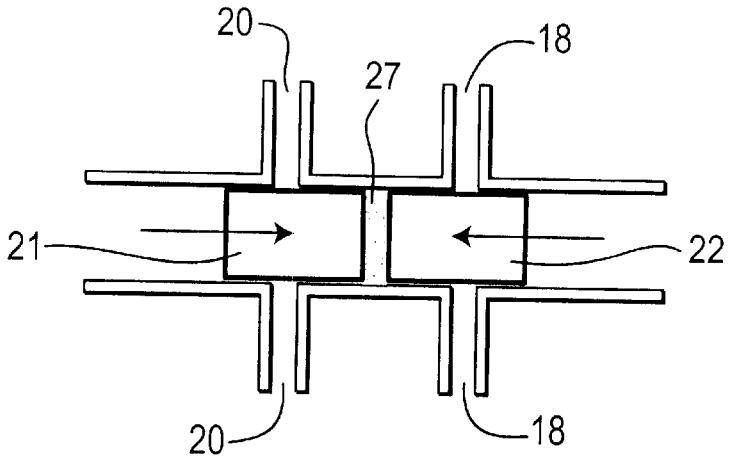
FIGS. 2*a*, 2*b* and 2*c* show the functional cycles of the engine.
Figure 2B:
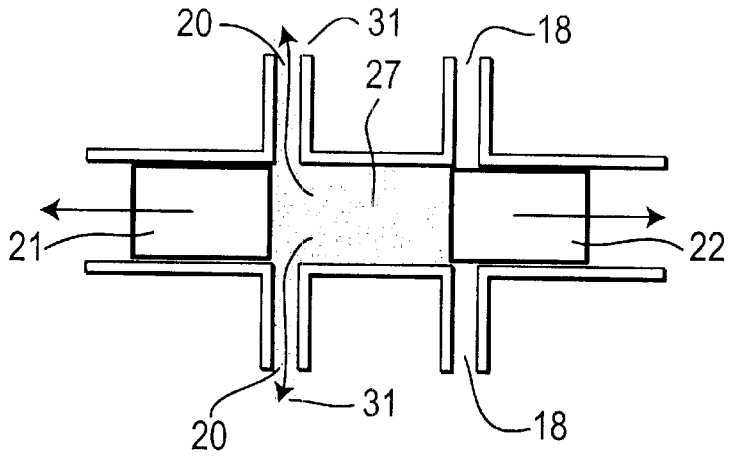

FIG. 2*a* illustrates an air-fuel mixture 31 being compressed in chamber 27 by pistons 21 and 22 moving towards each other. Mixture 31 is compressed to a homogeneous auto-ignition. Ignited gas 31 expands and cylinder 21 uncovers exhaust ports 20, allowing exhaust gas 31 to escape into the ambient environment, as shown in FIG. 2*b*.

Figure 2C:
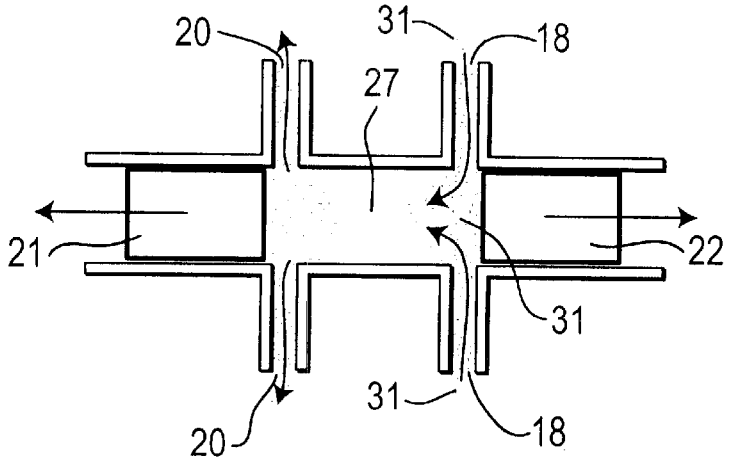

FIG. 2*c* reveals piston 22 uncovering input ports 18, where a new air-fuel mixture 31 enters chamber 27 and flushes out residual exhaust gas 31. Pistons 22 and 21 are returned towards each other by air springs as effected by regions 28 and 30 (shown in FIGS. 1, 3 and 4 but not in FIG. 2*a*, 2*b* or 2*c*).

Figure 3:
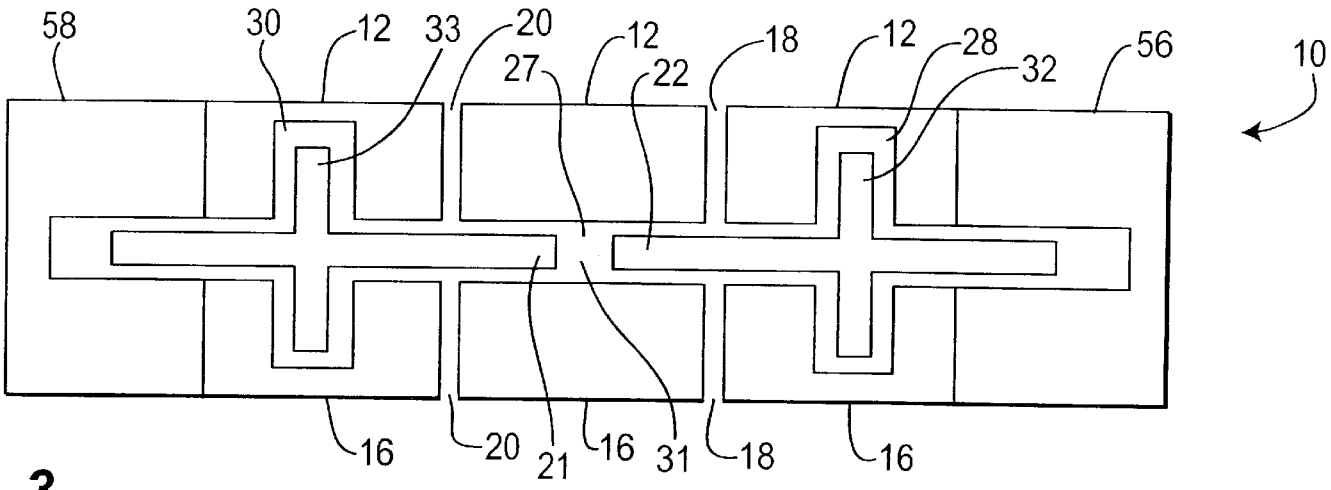
FIG. 3 is a cross-sectional view of the engine showing shaft-like pistons and larger piston-like air springs.

FIG. 3 reveals an MCE 10 having air spring regions 28 and 30 having special pistons 32 and 33 that provide the air spring returns for pistons 22 and 21, respectively. Pistons 21 and 22 are shaft-like ends that compress an air-fuel mixture 31 in chamber 27. Transducers/detectors 56 and 58 detect positions of pistons 22 and 21, respectively, and convert the mechanical energy of the pistons to electrical energy, and also exert forces on the pistons to keep them appropriately synchronized.

Electrical signals are output by transducers/detectors 58 and 56 by the motion or position of pistons 21 and 22 to sense piston synchronization errors in free piston engines having more than one piston. Electrical transducers 58 and 56 can be used to provide forces on pistons 21 and 22 to start the engine (i.e., to drive the pistons into resonance, as appropriate), generate electricity and correct piston synchronization errors (i.e., synchronize the pistons).

Figure 5A:
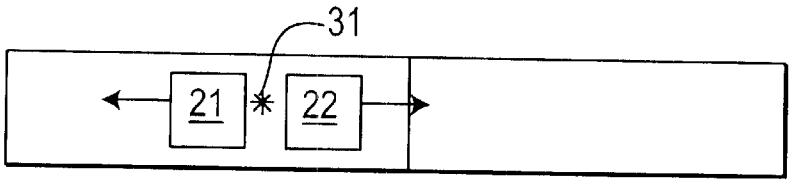
FIGS. 5*a*–5*d* illustrate synchronization error of the pistons in the engine.
Figure 5B:
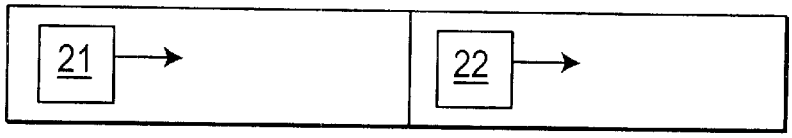
Figure 5C:
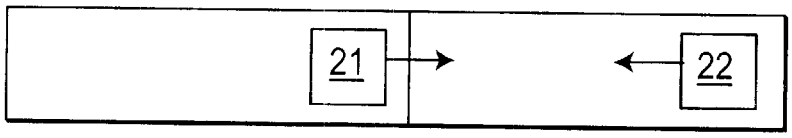
Figure 5D:
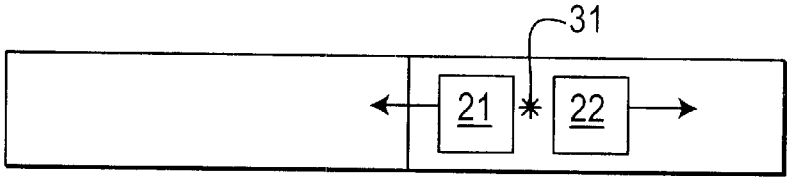
Figure 6:
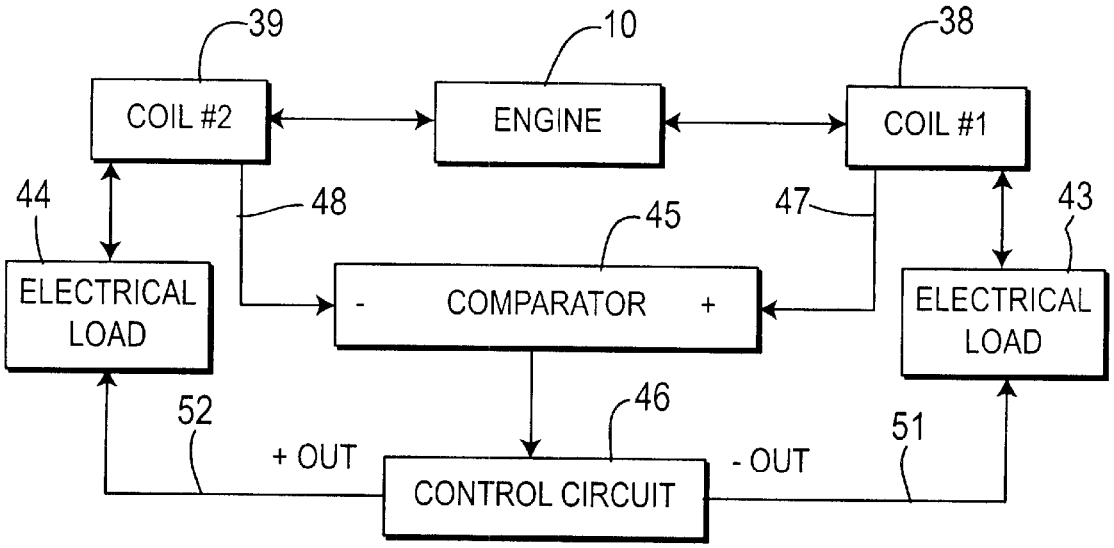
FIG. 6 is a diagram of the control electronics for the microcombustion engine.

An external circuit (as shown in FIGS. 5 and 6) determines the correct electrical force signals, based on the electrical sense signals from detectors 58 and 56. An electrical load impedance 53 in the electrical circuit is connected to the piston transducers such that the electrical force on each piston is a function of piston synchronization error, so that the resulting electrical forces on the pistons reduce the synchronization error. A non-linear electrical load impedance may be connected to the piston transducers. Such load impedance has an I-V characteristic chosen to optimize the electrical force feedback to each piston.

A circuit having active elements (transistors, diodes, and the like) may use electrical outputs from capacitive, inductive or optical sensors to determine piston position or motion, and apply appropriate electrical signals to the piston transducers to produce electrical forces on the pistons in order to reduce piston synchronization error. The piston transducers may also function as piston position detectors. Coils may be implemented to sense piston position or velocity in free-piston engines, and used as electrical transducers.

Figure 4:
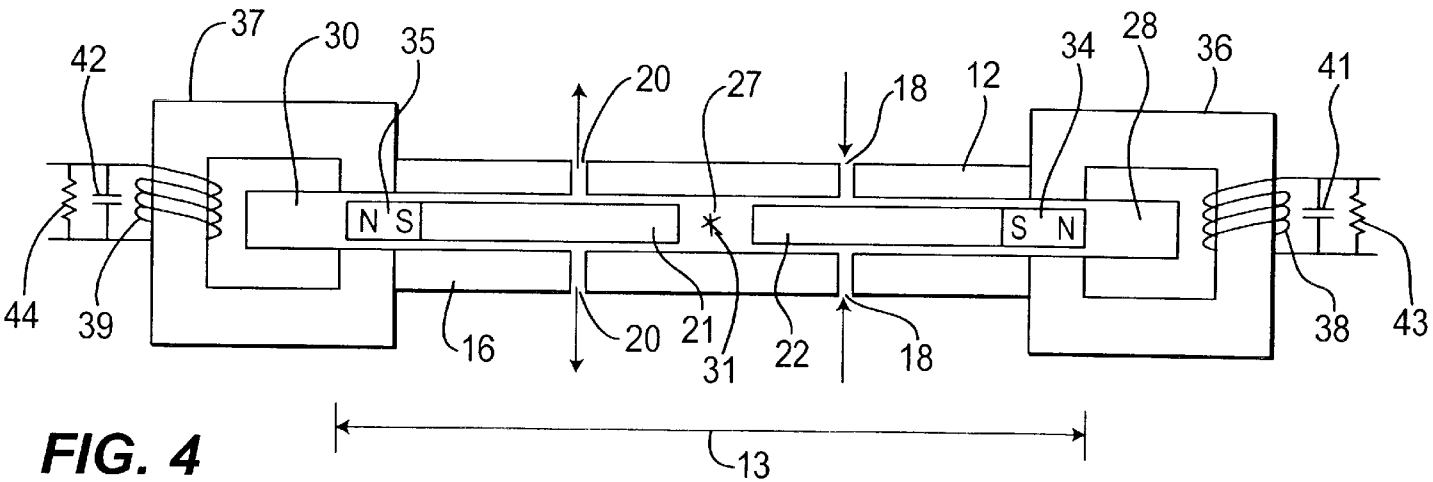
FIG. 4 is a cross-sectional view of the engine showing features for piston control and electrical energy generation.

FIG. 4 shows chambers 28 and 30 having shaft-like pistons 34 and 35, which compress air in chambers 28 and 30, respectively, to provide spring-like action upon compression of the air in chambers 28 and 30, by pistons 22 and 21 being forced away from each other by combustion of air-fuel mixture 31 in chamber 27. Dimension 13 is about one millimeter.

A synchronization error between the two pistons causes the combustion point to alternate between the left and right sides of the engine cylinder on successive cycles of the engine. Thus, a synchronization error causes each piston to arrive at the end of the cylinder early on one cycle, and late on the next cycle. As a result, the force applied to the piston to correct the synchronization error must change sign on each cycle. When the piston arrives at the end of the cylinder early, the applied force must act to slow down the piston. When the piston arrives at the end of the cylinder late, the applied force must act to speed up the piston. These corrective forces will tend to reduce the piston synchronization error.

FIGS. 5*a*–5*d* illustrate how piston synchronization error causes combustion point 31 to alternate between the left and right sides of the cylinder length, on each engine cycle. In FIG. 5*a*, combustion point 31 occurs to the left of the center of the engine cylinder. After combustion, both pistons 21 and 22 have the same speed. Piston 21 reaches the left end of the cylinder and then piston 22 reaches the right end of the engine cylinder, in FIGS. 5*b* and 5*c*, respectively. FIG. 5*d* shows pistons 21 and 22 meeting again with point 31 occurring to the right of the center of the engine cylinder length.

Also shown in FIG. 4 are electromagnets 36 and 37. Special shaft-like air-spring pistons 34 and 35 are also permanent magnets. Electromagnets 36 and 37 apply magnetic forces to pistons 22 and 21 to start microengine 10, as well as convert the mechanical energy of engine 10 to electricity. Also, electromagnets 36 and 37 provide piston synchronization. Each piston, 22 and 21, is shown as attached to a permanent magnet, 34 and 35, respectively, which oscillates in and out of one of electromagnets 36 and 37. Electromagnets 36 and 37 also inductively sense the motion of pistons 21 and 22, sense timing or synchronization errors in the motion of the two pistons 22 and 21, and apply appropriate forces to synchronize pistons 22 and 21, so that combustion always occurs at the proper location in engine cylinder or chamber 27.

Permanent magnets 34 and 35 attached to each of pistons 22 and 21 have a high Curie temperature, high residual induction, and high coercive force. These requirements are satisfied by SmCo, which has a Curie temperature of 825° C. (maximum operating temperature 300° C.), a residual induction of 10,500 Gauss, and a coercive force of 9000 Oersted. Each of permanent magnets 34 and 35 resides outside the engine cylinder, may be connected to its respective piston, 22 and 21, by epoxy. Each permanent magnet, 34 and 35, has a diameter of about 2 mm and a thickness of about 0.5 mm, resulting in a mass of about 13 milligrams.

In each of electromagnets 36 and 37, a core of soft magnetic material is used to concentrate the magnetic field energy of the coil near each piston magnet, 34 and 35. The soft magnetic material in the core of each coil, 38 and 39, increases the force during starting, for a given coil (38 and 39) current, and provides more efficient electrical power generation. The saturation field of the soft magnetic material is especially important, for good performance in the presence of the high-field permanent magnet (34 or 35) attached to the piston (22 or 21, respectively). Pure Fe has a saturation field of 22,000 Gauss. NiFe alloys are more amenable than pure Fe to fabrication of low-stress, crack-free layers using electroplating processes. These alloys can have adequately high saturation fields (e.g., 13,000 Gauss for 65% Ni, 35% Fe). The Curie temperature of NiFe alloys is typically high as well (e.g., approximately 400° C. for Permalloy). Eddy current losses in the soft magnetic material at the 5 kHz operation frequency of the engine can be made negligible by using thin laminations coated with a thin electrical insulator.

The coil (38 and 39) design consists of 500 turns of #30 wire (0.25 mm diameter) wrapped around a permalloy core which has a gap for the piston permanent magnet (34 and 35) to move in and out. The gap is about 1 mm wide, and the diameter of the Permalloy core at the gap is about 2 mm. The overall coil (38 and 39) dimensions are about 0.5 cm×1 cm×2 cm. There is one electromagnet (36 and 37) for each piston (22 and 21, respectively). Such a magnet can provide enough force to start microengine 10 in about 6 oscillations of the pistons 21 and 22 by applying only about 10 V. rms. The coil current during starting will be about 0.5 A. rms. For generation of electrical power from microengine 10, each coil (38 and 39) is connected to a capacitor (41 and 42) (about 1 $\mu$F.), forming a resonant circuit with the inductance of the coil (38 and 39). With such a circuit, each piston (22 and 21) can deliver about 4 W. rms. of electrical power to an output load impedance (43 and 44, respectively), with only 0.25 W. rms. dissipated in the coil (38 and 39). This indicates that nearly all of the available mechanical energy of the piston (22 and 21) is converted to electrical energy. If required, the coil (38 and 39) can extract more than 4 W. rms. electrical output power from the piston (21 and 22), if the output load impedance (43 and 44) is reduced. This also results in more power dissipation in the coil. The output circuit can be designed for high or low output load impedance by connecting the load (43 and 44) in series or in parallel with the capacitor (41 and 42, respectively), without changing the amount of power delivered to the load. The output load impedance is selected to be between 20 and 400 ohms.

Electrostatic methods of starting the engine and generating electrical power are an alternative approach. An electrostatic actuator can be used as a charge pump for electrical power generation, or as an actuator for starting engine 10. As the size of microengine 10 is reduced, electrostatic starting and power generation may be more practical than magnetic methods, due to the more favorable size scaling of electrostatic actuators as compared to magnetic actuators.

The air springs do not necessarily ensure a stable combustion position of the pistons 21 and 22. A drift of the pistons' positions may lead to engine stall or loss of fuel. Therefore, a stabilization mechanism or control technique is provided for piston synchronization.

In one approach, generator/starter electromagnets 36 and 37 are used as sensors for the pistons' combustion position. The phases of the AC output from the electromagnets are compared to determine where the combustion takes place. If the point of combustion drifts away from the center of the microengine (i.e., chamber 27), this point will oscillate from one side of the center of chamber 27 to the other side on alternating cycles of engine 10. During each cycle of the engine, one permanent magnet of a piston arrives at its respective coil late, and the permanent magnet of the other piston arrives at its coil early. This results in a phase difference between the two electrical outputs. This phase difference is sensed and used to apply appropriate feedback current to the coils of respective electromagnets 36 and 37, to provide corrective forces to the pistons. The circuit is shown in FIG. 6. The sensing 47 and 48 and feedback 51 and 52 are performed with relatively simple transistor circuits 45 and 46. Circuit 45 is a comparator that receives sensing signals 47 and 48 from coils 38 and 39 and outputs a resultant signal to circuit 46. Circuit 46 is a control circuit that outputs feedback signals 51 and 52 to coils 38 and 39 via electrical loads 43 and 44, respectively. For example, the electrical load (43 and 44) impedances seen by coils 38 and 39 can be dynamically controlled so that the resulting changes in the coil (38 and 39) currents alter the magnetic forces on piston magnets 34 and 35, respectively. Alternatively, one may "phase-lock" pistons 22 and 21 by simply connecting electromagnet coils 38 and 39 in parallel. In this configuration, when one piston magnet (34 or 35) arrives at its coil (38 or 39) early, the resulting induced electromagnetic force drives current through the other coil (39 or 38, respectively) causing an attractive force accelerating the other piston magnet (35 or 34, respectively) into its coil (39 or 38), thus reducing the difference in arrival times of the piston magnets at their coils.

Figure 7:
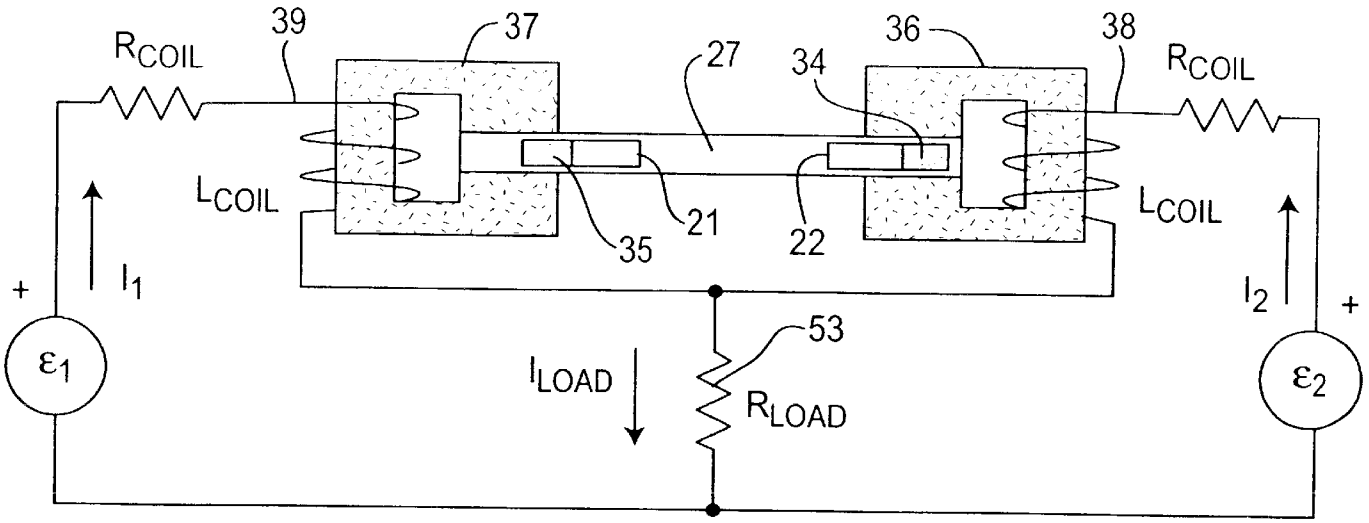
FIG. 7 is a diagram illustrating a parallel connection of two electromagnets to a load resistor for piston synchronization.

Several types of feedback circuit can be used to determine the appropriate force to be applied to each piston. One approach is to simply connect the electrical generators for two pistons 21 and 22 in parallel with a single load impedance 53, as shown in FIG. 7. If pistons 21 and 22 and their electromagnet coils 39 and 38 are identical, then when the pistons are synchr4onized, induced emf's $\epsilon_1$ and $\epsilon_2$ are equal and in-phase, and the two currents $I_1$, and $I_2$ are equal and in-phase, and $I_{load}=2I_1=2I_2$ (care must be taken to connect the coils so the currents $I_1$, and $I_2$ do not cancel each other to give zero current in the load impedance).

The favorable effect of the circuit in FIG. 7 on the piston forces can be seen by considering the case where pistons 21 and 22 spend most of their time outside coil cores 37 and 36, so the induced emf's $\epsilon_1$ and $\epsilon_2$ are a series of voltage pulses 54 and 55 caused by the piston magnets 35 and 34 passing in and out of coil cores 37 and 36. The emf changes sign within each pulse, as the piston magnet enters the coil then leaves the coil. The emf ($\epsilon_1$ or $\epsilon_2$) induced by the magnet attached to the piston will always drive current through the coil to resist the motion of the piston. If piston 21 arrives at coil 39 before piston 22 arrives at coil 38, then a portion of current $I_1$ will initially be driven through coil 38, causing a magnetic field that produces an attractive force on piston 22, accelerating its motion into coil 38. Also, the initial absence of $\epsilon_2$ reduces the impedance seen by $I_1$, and hence $I_1$ will be larger than when pistons 21 and 22 are synchronized. This results in a stronger repulsive reaction force on piston 21 as it enters coil $L_1$. These changes in the forces on pistons 21 and 22 tend to correct the synchronization error, by extracting additional energy from the leading piston and extracting less energy from the lagging piston.

The effect of the circuit in FIG. 7 on the piston kinetic energy throughout the entire excursion of the pistons into and out of the coils is calculated in the following simple model. This model shows that the circuit is effective in correcting piston synchronization error. The model incorporates the following assumptions. The induced emf produced by each piston is proportional to piston velocity whenever the attached piston magnet is at least partially inside its electromagnetic coil. The induced emf is zero whenever the piston magnet is completely outside the coil. The piston velocity has a constant positive value as the piston magnet enters the coil, and a constant negative value as the piston leaves the coil. This reversal of the velocity could be produced by the piston bouncing off the end of the engine cylinder. The piston speed is assumed to be constant, for purposes of determining the induced emf and the coil current. The time the piston magnet spends outside the coil is sufficiently long that the coil current decays to zero between excursions of the piston magnet into the coil.

Figure 8:
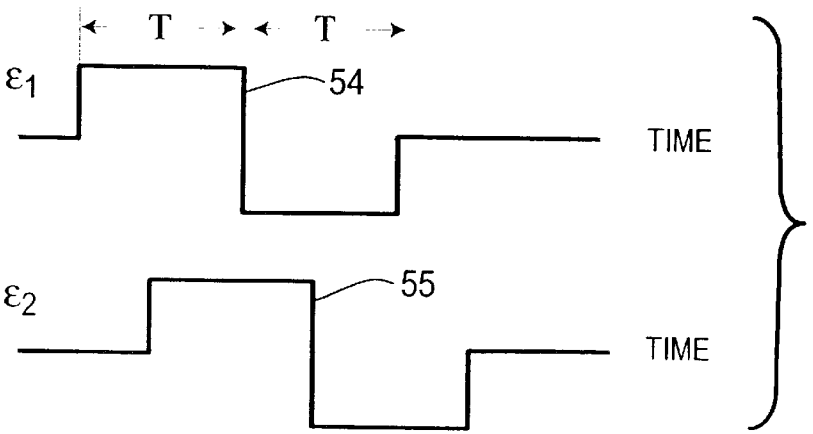
FIG. 8 shows a timing diagram of induced emf's of the engine in FIG. 7.
Figure 9:
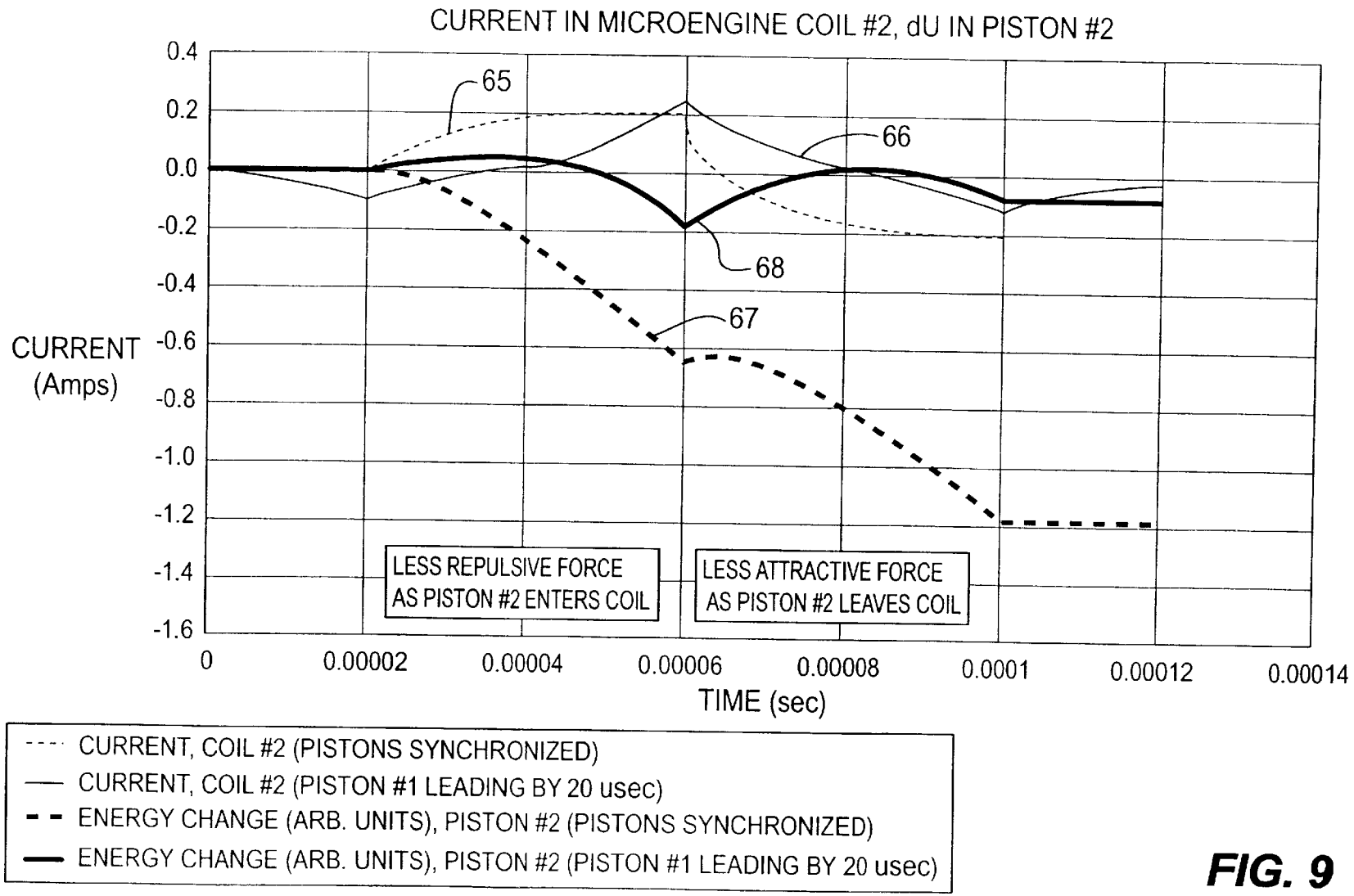
FIGS. 9 and 10 show the electromagnetic coil current and change of kinetic energy for each of the two pistons, respectively, of the engine.
Figure 10:
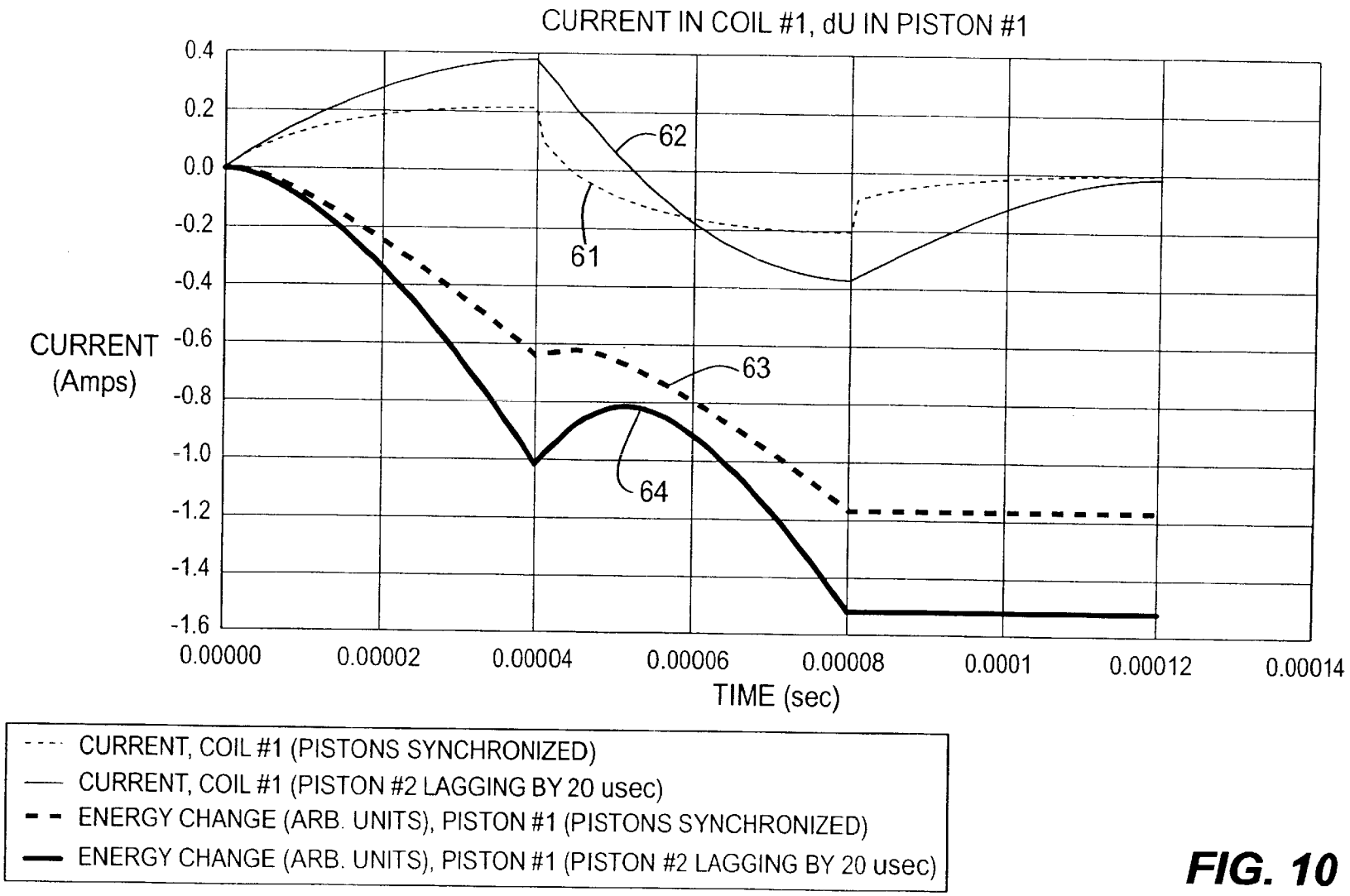

With the above assumptions, the induced emf's $\epsilon_1$ and $\epsilon_2$ are a series of single-cycle square wave pulses 54 and 55, as shown in FIG. 8. Piston synchronization error causes the $\epsilon_1$ pulse 54 to start at a different time than the $\epsilon_2$ pulse 55. FIGS. 9 and 10 show the calculated currents $I_1$ and $I_2$ in the circuit of FIG. 7, with the emf's given in FIG. 8. Two cases are presented: first, no synchronization error; and second, piston 22 lagging piston 21 by 20 microseconds ($\mu$sec.). The assumed circuit parameters are $L=9.1\times10^{-4}$ henries, $R_{coil}=2.7$ ohms, and $R_{load}=40$ ohms. It is assumed that the time T in FIG. 8 is 40 microseconds ($\mu$sec.). Note that the simplified circuit of FIG. 7 has no capacitors. Capacitors with values chosen to resonate with the electromagnet coils may greatly improve the efficiency of the electromagnets in converting piston mechanical energy to electrical energy. However, for simplicity, they are excluded from the calculations of FIGS. 9 and 10.

When a piston makes an excursion in and out of electromagnet coils, some of its kinetic energy is transformed into electrical energy. The primary result shown in FIGS. 9 and 10 is that when piston 22 lags piston 21, the total decrease in piston kinetic energy during such an excursion is enhanced for the leading piston (piston 21) and reduced for the lagging piston (piston 22), relative to the case where the pistons are synchronized. This effect changes the piston velocities in such a way that synchronization error is reduced.

The amount of reduction of synchronization error on each cycle of the microengine can be adjusted by varying load impedance 52 in the circuit of FIG. 7. This can also be accomplished by using a non-linear load impedance. The latter approach may allow the circuit to be optimized for correcting synchronization error without degrading the power output. Consider a non-linear load impedance that has lower resistance at low currents than at high currents. The leading piston would produce a relatively large initial current (and hence a large repulsive force on the leading piston magnet). Later, when the lagging piston magnet enters its electromagnet coil, the coil would see an enhanced load impedance, due to the pre-existing current in the load impedance. Thus, the lagging piston would produce less current (and hence feel a smaller repulsive magnetic force). The power output would depend mostly on the load impedance at the average output current. However, the effectiveness in correcting synchronization error would depend in part on the derivative of output load impedance with respect to current. Thus, output power and synchronization error correction could be optimized somewhat independently by an appropriate choice of output impedance non-linear characteristics. Suitable non-linear devices include non-linear resistors, diode networks or transistors. The load impedance I-V characteristic must be independent of the direction of current flow. Thus, a single diode is not suitable.

FIG. 9 shows the electromagnetic current and the change in piston kinetic energy for coil 1 and piston 21. When piston 21 leads piston 22 by 20 microseconds, piston 21 loses more energy to the electrical circuit than when the pistons are synchronized. This tends to correct the piston synchronization. Curve 61 reveals the current in coil 1 when the pistons are synchronized. Curve 62 reveals the current in coil 1 when piston 22 is lagging piston 21 by 20 microseconds. Curve 63 shows the energy change in arbitrary units of piston 21 when the pistons are synchronized. Curve 64 shows the energy change in arbitrary units of piston 21 when piston 22 is lagging piston 21 by 20 microseconds.

FIG. 10 shows the electromagnetic coil current and change in piston kinetic energy for coil 2 and piston 22. When piston 22 lags piston 21 by 20 microseconds, piston 22 loses much less energy to the electrical circuit than when the pistons are synchronized. This tends to correct the piston synchronization error. Curve 65 reveals the current in coil 2 when the pistons are synchronized. Curve 66 reveals the current in coil 2 when piston 21 leads piston 22 by 20 microseconds. Curve 67 shows the energy change in arbitrary units of piston 22 when the pistons are synchronized. Curve 68 shows the energy change in arbitrary units of piston 22 when piston 21 leads piston 22 by 20 microseconds. With piston 21 leading piston 22, as shown here, there is less repulsive force as piston 22 enters coil core 36, and less attractive force as piston 22 leaves coil core 36.

The microengine could be provided with additional coils to sense the position of the pistons. Each sense coil would be connected to active circuitry (transistors, op-amps, and the like) having a high input impedance. Thus, very little current would flow in the sense coils, so they would exert very little force on the pistons. The sense coil circuitry would inject appropriate feedback current into the main electromagnet coils, or actively vary the output impedance of the main coils, to correct the synchronization error. The advantage of this control method is that the sense coils are separate from the coils used to apply feedback force to the pistons. The separation of sensing and feedback functions would allow greater design flexibility and hence improved correction of synchronization error. However, this approach is significantly more complex than the simple passive control method described above.

Providing the microengine with separate coils for electrical power generation and correction of synchronization error allows these functions to be relatively independent of each other. Each piston would feel forces from the two coils during each cycle of the engine. Ideally, the largest force would be exerted by the electrical power generator coil, in order to obtain maximum power output from the microengine.

Figure 11A:
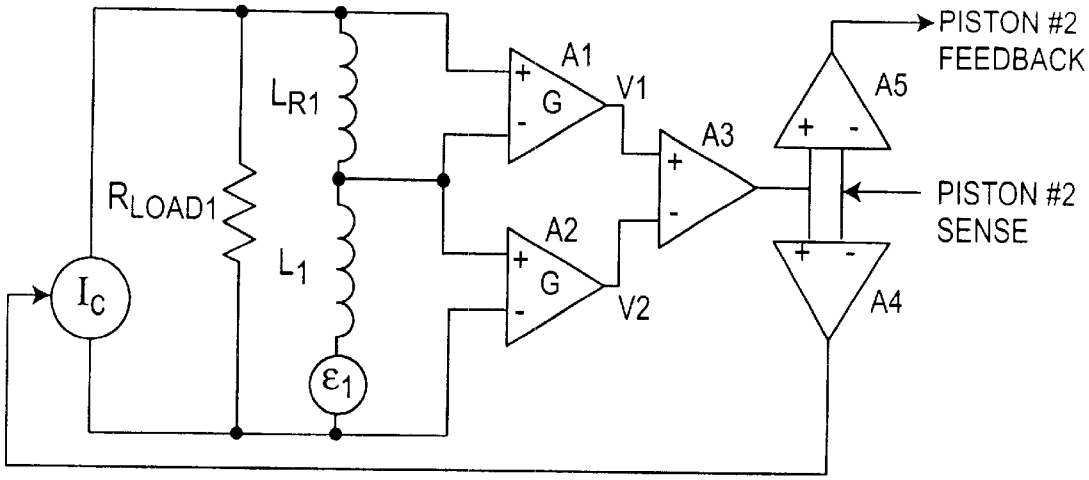
FIGS. 11*a* and 11*b* are schematics of inductance bridge circuitry for piston synchronization error correction.
Figure 11B:
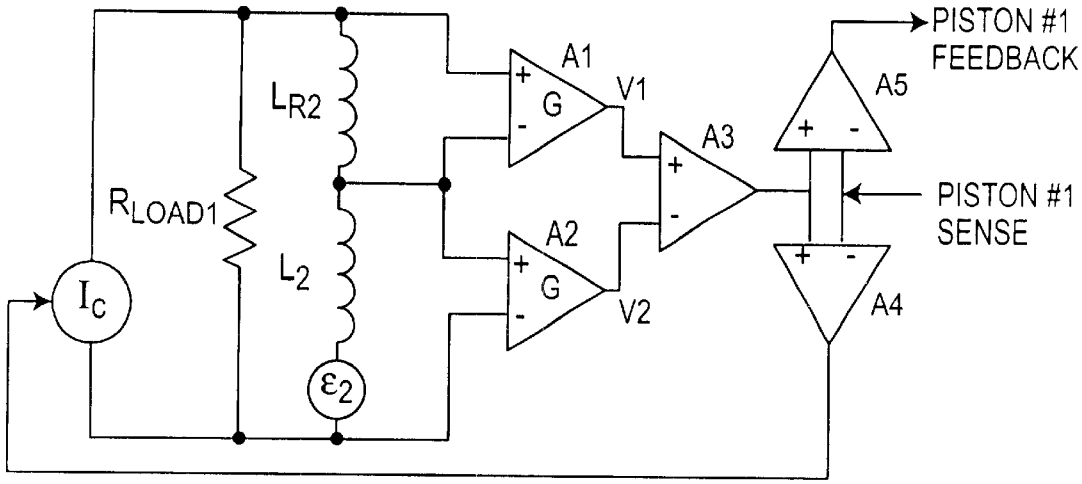

An inductance bridge circuit in FIGS. 11*a* and 11*b* could be used to sense the emf induced by each piston magnet and provide feedback current to correct the synchronization error. FIG. 10*a* shows inductance bridge circuit for synchronization error correction. Moving piston magnet 35 of piston 21 induces emf $\epsilon_1$ in coil $L_1$. Moving piston magnet 34 of piston 22 induces emf $\epsilon_2$ in coil $L_2$. The circuit is for piston 21 and the electrical connections to the circuitry for piston 22 are shown. The circuit of FIG. 10*b* is shown for piston 22, which reveals the electrical connections to the circuitry for piston 21. In FIG. 10*a*, the piston magnet induces an emf $\epsilon_1$ in coil $L_1$. Reference coil $L_{R1}$ has the same inductance as coil $L_1$. The same current $I_1$ flows through reference coil $L_{R1}$ and coil $L_1$, due to the high input impedance of op-amp circuits A1 and A2. Thus, the difference between voltages V1 and V2 is just the emf $\epsilon$ times the gain G of op-amp circuits A1 and A2. Op-amp circuit A4 compares the emf's from piston 21 and piston 22. If the two induced emf's are not the same, the output of A4 provides appropriate feedback to controllable current source $I_C$ to correct the synchronization error by changing the current in coil $L_1$. Note that the feedback current has no effect on the voltages V1 and V2, because it flows through both coils $L_{R1}$ and $L_1$.

This circuit has the advantage of providing an electrical signal giving an unambiguous measurement of synchronization error, without putting additional coils on the microengine. This signal can be used to provide feedback to the electromagnet coils using a variety of active circuits designed specifically for correcting the synchronization error. The circuits in FIGS. 11*a* and 11*b* are not very simple. However, active electronic components are small and low cost, whereas putting additional coils onto the microengine may be difficult because of the small amount of space available without interfering with the hot combustion region, the fuel and exhaust ports, and the other coils.

A linear array of optical detectors arranged along the length of a microengine cylinder with a transparent wall could be used to measure piston synchronization error. Light emitted during combustion would be detected, with the detector nearest the point of combustion giving the largest signal. Alternatively, optical detectors could measure piston synchronization by determining when the edges of the pistons pass the detectors. These measurements could be made very quickly (a few nanoseconds), and with very high resolution (piston position measured to a few microns). This would allow implementation of fast control circuitry. A feed-forward control algorithm could be used, where active circuitry would apply control current to the coil before the piston enters the coil, allowing enhanced control over the magnetic force on the piston.

Figure 12:
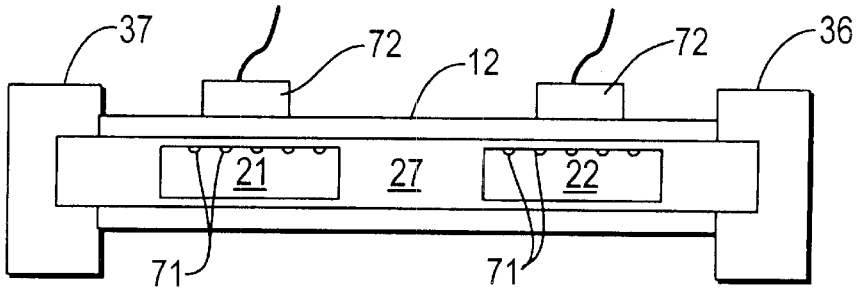
FIG. 12 reveals an optical detection scheme for determining the position and velocity of the engine pistons.

The velocity of the pistons could also be measured optically, by patterning graticules 71 on the pistons. A fixed optical detector 72 would measure the elapsed time between passage of successive graticules 71 and the piston edge to indicate piston velocity (in FIG. 12). The combination of position and velocity measurements would allow precise prediction of the arrival time of the pistons at transducers 36 and 37.

These optical detection approaches have the design flexibility advantage of the active-circuit feedback mentioned previously. Also, the functions of sensing the synchronization error and applying forces to correct it are performed by separate components. The piston position and velocity can be measured precisely, quickly, and with high resolution, before the piston enters the electromagnet coil. Finally, optical detectors can be small enough to be located close to the microengine. However, this approach requires a cylinder wall transparent to the wavelength of the light or radiation from the engine being sensed by the optical detectors.

Returning to the mechanical description of engine 10, the location of the ports 20 and 18 is not over the region where the piston travels but over the vents 24 and 26, respectively. The position of the vents is crucial to the operation of engine 10. This position is a primary control parameter to the operation of the engine. Results of an initial analysis of a single-piston engine are in the following Table 1.

Starting with presently available, small model airplane engines of 0.015 in.$^3$ displacement, one envisions the need for displacements of over an order of magnitude smaller, i.e., in the 0.0005–0.002 in.$^3$ range.

To maximize life and performance, one selects a dual-opposed, linear free-piston engine design, due to its low friction and wear (no side thrusts caused by a crankshaft), coupled to a linear electromagnetic generator. A heuristic set of assumptions was made and listed in Table 1 (with an asterisk "*") together with derived data, to determine the feasibility and qualitative performance of such an engine.

A heuristic set of assumptions was made and listed in Table 1 (with the asterisk) together with derived data, to determine the feasibility and qualitative performance of such an engine, first one with a single piston. The dual-piston version is discussed in the discussion of engine-related issues, following Table 1.

TABLE 1

SOME DESIGN AND PERFORMANCE DATA FOR A FREE PISTON ENGINE

| | cm/g/s | m/kg/s (SI) | in./lb/h | Comments |
|---|---|---|---|---|
| *Piston length | 1 | 0.01 | 0.400 | |
| *Piston diameter | 0.2 | 0.002 | 0.080 | $A = \pi d^2/4$ |
| Piston density | 7.6 | 7600 | | |
| Piston mass | 0.24 | 0.00024 | | |
| Displacement | | | | |
| (stroke) | 0.4 | 0.004 | 0.160 | |
| (vol.) | 0.013 | $1 \cdot 3 \cdot 10^{-8}$ | 0.00077 | |
| Intake pressure | $\leqq 0.98 \cdot 10^{+6}$ dyn/cm | $0 \cdot 98 \cdot 10^{+5}$ Pa | 14.7 psia | No turbo charging |
| Compression ratio | 30:1 | | | |
| Peak pre-comb. press. | $\leqq 150 \cdot 10^{+6}$ | $150 \cdot 10^{+5}$ Pa | 2250 psia | |
| Peak post-comb.press. conditions | $\leqq 300 \cdot 10^{+6}$ | $300 \cdot 10^{+5}$ Pa | 4500 psia | Adiabatic, optimal |
| Comb.energy release combustion | $\leqq 0.021 \cdot 10^{+7}$ erg/stroke | $\leqq 0.021$ J/stroke | | Q, at stoichiometric |
| avg.output at 1000 Hz | $\leqq 21 \cdot 10^{+7}$ erg/s | $\leqq 21$ watts | $\leqq 71$ Btu/h | |
| avg.output at 3000 Hz | $\leqq 63 \cdot 10^{+7}$ erg/s | $\leqq 63$ watts | $\leqq 233$ Btu/h | |
| Actual heat release rate $40 \cdot 3.58$ W/cm$^2$ | $143 \cdot 10^{+7}$ erg/(s cm$^2$) | of laminar flame front | | $dq/dt = S_u \cdot \Delta H =$ |
| | $305{,}000 \cdot 10^{+7}$ erg/(s cm$^2$) | of detonation front | | $dq'/dt = S'_u \cdot \Delta H =$ |
| $33000\ (T/T_o)^{0.5} \cdot 3.58$ W/cm$^2$ | | | | |
| Time to complete comb. | 1.35 $\mu$s | | | $\tau = Q/(A\ dq'/dt)$ |
| Natural frequency | 3000 Hz | | 180,000 RPM | |
| *Average intake.temp. | $\leqq 600$ K | | | |
| pre-comb.temp. | $\leqq 2000$ K | | | |
| Peak post-comb.temp. | $\leqq 4000$ K | | | Assuming adiabatic |
| | conditions, based on | | | $\Delta H(mix)/c_p \leqq 2550$ K, w/o dissociation |
| *Exhaust port diam. | 0.1 | 0.001 | 0.040 | |
| ctr.dist.from TDC | 0.25 | 0.0025 | 0.100 | |
| Exhaust open time | $\geqq 150$ micro-seconds | | | |
| flush time | $\leqq 26$ micro-seconds | | | At speed of sound; |
| $\Delta p \sim 3.8$ bar | | | | |
| | 2.4 micro-seconds | | | At speed of viscous |
| flow (however, | | | | Re ~ 250,000) |
| Exhaust gas viscosity | $\sim 200 \cdot 10^{-6}$ | $200 \cdot 10^{-5}$ | | |
| speed of sound | ~46000 | 460 | | |
| specific heat | ~7.5 cal/(mol K) | 31.38 J/(mol K) | | |
| *Intake port diam. | 0.1 | 0.001 | 0.040 | |
| Ctr.dist.from TDC | 0.35 | 0.0035 | 0.140 | |

TABLE 1-continued

SOME DESIGN AND PERFORMANCE DATA FOR A FREE PISTON ENGINE

| | cm/g/s | m/kg/s (SI) | in./lb/h | Comments |
|---|---|---|---|---|
| Gas spring min. p | $3 \cdot 10^{+6}$ | $3 \cdot 10^{+5}$ Pa | 44 psia | |

There are several issues. One involves ignition induction and delay times. The usual values of 1–2 ms in conventional engines need to be reduced by about 1000 times; such low values can be predicted from extrapolation of test data. They also have been observed in high-pressure flames ($\leqq 100$ bar) and shock waves.

Another issue is wall quenching of combustion. At ambient pressure, the quenching distance (q) is about 2.5 mm, but it decreases as pressure and temperature increase ($q \sim 1/p$); above T~1600 K, $q \approx 0$.

Surface to volume ratio is also an issue. The small size of microengines raises the losses associated with large surface to volume ratios, i.e., losses to the cylinder wall. There are three aspects that are addressed and are given preliminary consideration. The first is leakage of mixture through the piston-cylinder space during pre-combustion compression. The second is friction between piston and cylinder, which may be primarily due to viscous drag; and the third is the rapid heat loss via thermal conduction between the hot gas and the relatively cold cylinder walls, during compression and after combustion.

Under an assumed 5 $\mu$m radial piston-cylinder spacing, one can estimate that the loss is well below ten percent of the fuel+air charge. Estimated power dissipation due to friction for average, relative piston-cylinder speeds of 10 m/s amounted to ~30 mW. of power; including the leakage flow (with peak speeds up to six times greater), brings the friction loss up to about one watt; these dissipations are based on lube- and condensation-free operation, i.e., on air bearing. However, an oil film would both reduce the leakage and increase friction (about forty times) with a net result of total dissipation again in the one watt range.

Another issue is exhaust and intake port limitations. As the speeds of microengines increases, less time is available for completing the exhaust and intake flow functions, which in fact are limited by the speed of sound. Furthermore, the Reynolds No. increases as the gas density increases, increasing resistance to exhaust and scavenging flow. As shown above in Table 1, the available time for exhaust is about 150 microseconds ($\mu$s), which is long compared to the times needed for flushing at speed of sound flow rates (26 $\mu$s). After the narrow intake and exhaust port openings (one mm inside diameter), one would be wise to select a larger cross section. Pressurization of the intake fuel-air mixture may not be needed or practical.

Output power regulation is also an issue. By restricting the flow rate and the fuel concentration (lean burning) of the intake mixture, the engine output can be controlled.

Figure 13:
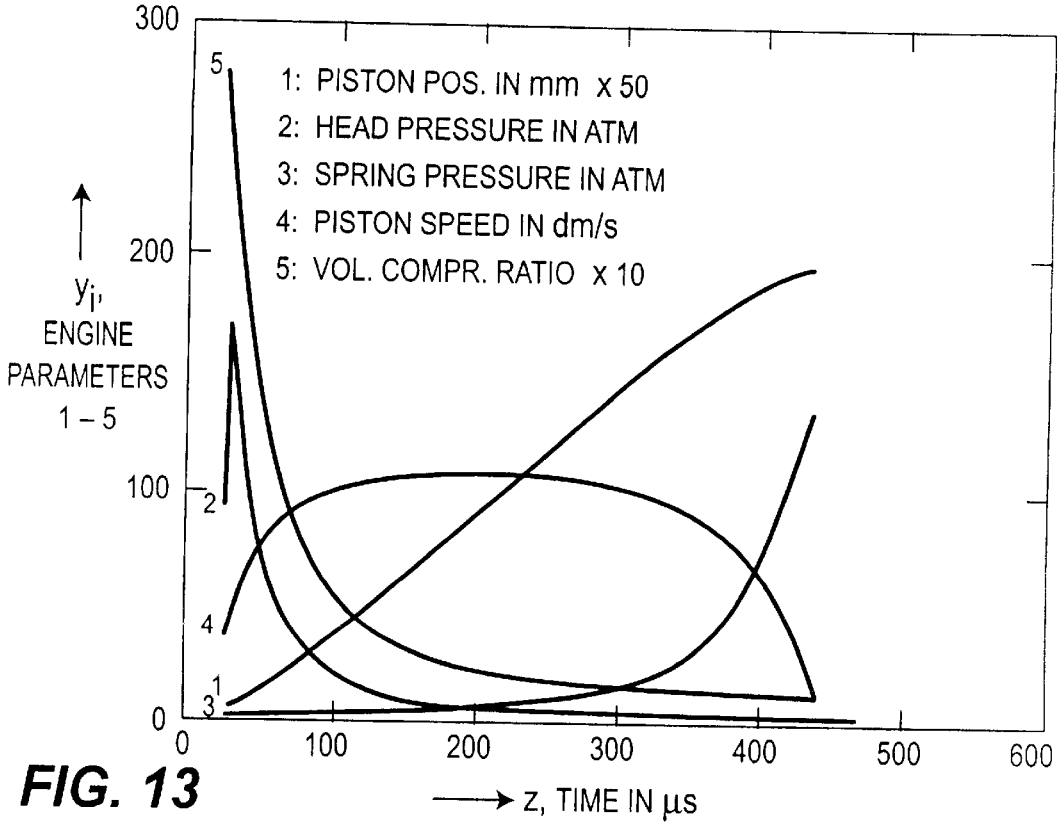
FIG. 13 is a graph of combustion parameters of a linear free piston microengine having a 2 mm diameter and a 4 mm stroke, without losses, for a compression ratio of 30:1.

Gas spring control is to be noted. Preliminary computations as those shown in FIG. 13 have shown that (minimum) spring pressures above ambient are advantageous to insure a more balanced operation than what one would achieve by setting the minimum at ambient pressure. The computed results shown in FIG. 13 were obtained with a minimum spring pressure of 3 bar (44 psia) and a stroke of 4 mm.

Inertial compensation is of concern. The engine calculations displayed above were for a single piston engine. Such a system would transfer vibration to its supporting structure and run against the goal of achieving minimum size while not compromising its service life. One can therefore propose to apply the above insights towards the design of an engine consisting of two, opposed, in-line and in-plane pistons, as have been proposed before for larger engines. Such a design facilitates the exhaust and intake functions (as the pistons move away from top dead center), and eliminates external vibrations, although strictly symmetrical operation needs to be maintained. The above data could serve to represent such a dual piston system, provided one increases the output power and flush times by two times, without changing the frequency.

Figure 14:
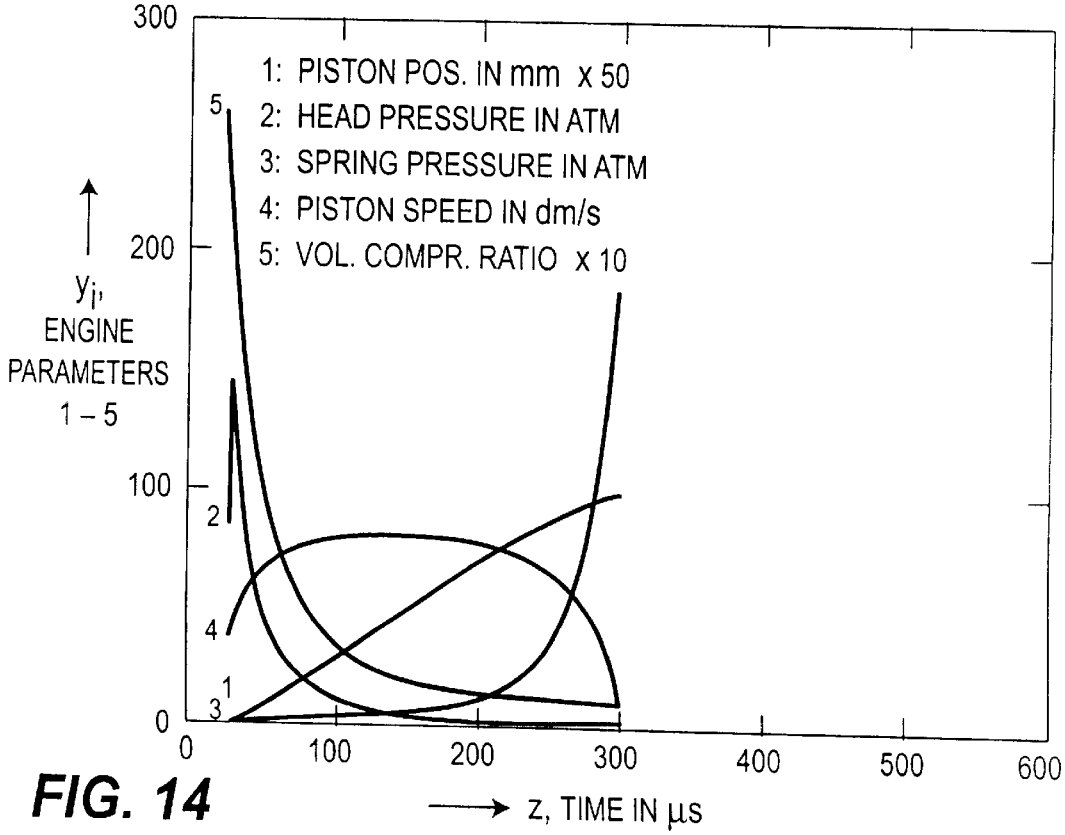
FIG. 14 is a graph of combustion parameters of a linear free piston microengine having a 2 mm diameter and a 2 mm stroke, without losses, for a compression ratio of 30:1.

Engine noise output is notable. To avoid the noise in the audible range (model airplane engines of 0.015 in.$^3$ displacement, operating at 35,000 RPM or about 500 Hz are not welcome in a stealth operation or quiet neighborhood), it would be desirable to shift the main frequency to above 20,000 Hz. By cutting the stroke of the above design to 2 mm (see FIG. 14), the frequency would about double to about 6,000 Hz; and reducing the piston diameter to ~1 mm and its mass to one-fourth, the frequency goal of greater 20,000 Hz can theoretically be achieved. Challenges in the form of shorter charging and exhausting times and relative friction losses will be addressed by verifying our model and scaling laws with the 2 mm diameter piston engine.

Engine performance evaluation via mathematical modeling—viscous flow was evaluated with the equation known as Poiseuille's law for laminar, volumetric flow in capillaries of radius, r, and length, L, and dynamic viscosity, $\eta$:

$$V=\pi r^4 \Delta p/(8L\eta). \quad (1)$$

Friction (power dissipation or force*speed) losses between piston and cylinder were estimated with the equation that defines the transfer of momentum between two surfaces sliding against each other on a fluid film of viscosity, $\eta$, thickness, s, surface area, A, and speed, v:

$$Q=F\cdot v=\eta v^2 A/s. \quad (2)$$

Figure 15:
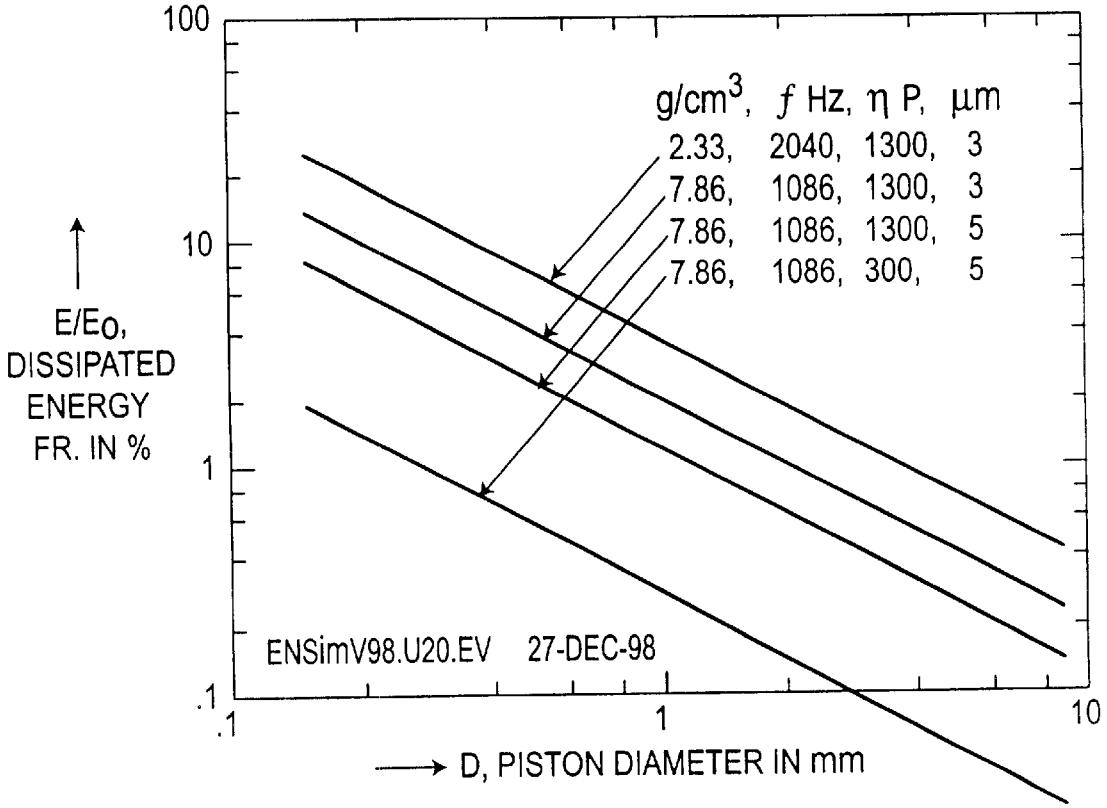
FIG. 15 is a graph of energy fraction dissipated by viscous drag over one complete power stroke of 2 mm, for indicated conditions.

One remarkable result of this relation is that the fraction of the piston's kinetic energy dissipated by viscous drag over a given time increment is constant in spite of changes in speed, because both kinetic energy and Q are proportional to $v^2$, and the remaining piston speed fraction is $\{1-8\eta/(s\ D\ \rho)\}^{0.5}$, with D=piston diameter, and $\rho$=its density. This relationship shows the dissipation of piston energy over a complete expansion stroke as its diameter is reduced to MEMS sizes. As shown, viscous losses are reduced as the piston density is increased from that of Si to that of Fe (2.33 to 7.86 g/cm$^3$) also associated with a reduction in engine frequency, the gap or lubricating film thickness is increased from 3 to 5 $\mu$m, and the lubrication fluid viscosity is reduced from that of liquid water to that of air (1300 to 300 $\mu$P). The worst of the above cases is the first one, i.e., operation with a silicon piston with liquid water as the lubricant at a film thickness of 3 $\mu$m, but even under that case the energy loss is about 20 percent for a piston of only 0.2 mm in diameter (see FIG. 15).

The compressed state of the pre- and post-combustion gases may cause the leakage gas velocity to exceed the piston speed, so that one needs to ask whether this would increase the effective drag on the piston even further. A closer look reveals that even at a peak pre-combustion pressure difference of 150 bar the gas leak rate would decelerate the piston less than the greater acceleration contributed during the power-expansion stroke starting at about 300 bar and a peak leak rate (for incompressible gas) of well over 60 m/s.

Pressure and temperature rises due to adiabatic compression were computed by making a simplifying assumption that both pre- and post combustion gases are composed of 80 percent $N_2$ ($c_p$=7.17 cal/mol K at 300° C.) and 20 percent of a gas with $c_p$=9.9 cal/(mol K) to yield an average $c_p$=7.8, regardless of pre- or post-combustion, i.e., $\gamma$=1.341, so that pressure and temperature rise during compression proceeded according to $pV^\gamma=p_o V_o^\gamma$ and $T/T_o=(V_o/V)^{\gamma-1}=(P/p_o)^{(\gamma-1)/\gamma}$.

Although the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

What is claimed is:

1. A microcombustion engine comprising:

a chamber;

a first piston situated in said chamber;

a second piston situated in said chamber;

at least one intake port in said chamber;

at least one output port in said chamber; and wherein said first and second pistons are moveable towards each other so as to compress and ignite a fuel mixture into a combustion without a spark and that forces said first and second pistons to move away from each other, resulting in a burnt fuel mixture leaving said chamber through said at least one output port and another fuel mixture entering said chamber through said at least one intake port to be compressed and ignited by said first and second pistons into a knock combustion that again forces said first and second pistons to move away from each other.

2. The engine of claim 1, further comprising:

a first electromagnet proximate to said first piston;

a second electromagnet proximate to said second piston;

wherein said first and second electromagnets convert kinetic energy from said first and second pistons, respectively, into electrical energy.

3. The engine of claim 2, wherein said first and second electromagnets drive said pistons into resonance, generate electricity and synchronize said first and second pistons.

4. The engine of claim 3, wherein said chamber and first and second pistons are micromachined from at least one material from a group consisting of silicon, ceramic, sapphire, silicon carbide, Pyrex and metal.

5. The engine of claim 1 which has a length of about 1 millimeter or less.

6. The engine of claim 1 comprising a substantially planar inner layer attached on opposing surfaces thereof to a pair of substantially planar outer layers and said chamber being formed in said inner layer.

7. A microcombustion engine comprising:

a chamber;

a first piston situated in said chamber;

a second piston situated in said chamber, wherein said first and second pistons are moveable towards each other so as to compress and ignite a fuel mixture into a combustion without a spark;

a first detector proximate to said first piston;

a second detector proximate to said second piston;

a first transducer proximate to said first pistons; and a second transducer proximate to said second piston.

8. The engine of claim 7, wherein said chamber, and said first and second pistons are micromachined.

9. The engine of claim 8, wherein said first and second pistons may move towards each other in said chamber to compress a fuel mixture to result in a homogeneous auto ignition of the fuel mixture into a combustion.

10. The engine of claim 9, further comprising:

an input port situated in said chamber; and an exhaust port situated in said chamber.

11. The engine of claim 10, wherein:

said first and second pistons are moved away from each other by the combustion;

contents of the combustion exit said chamber via said exhaust port; and the fuel mixture enters said chamber via said input port.

12. The engine of claim 11, wherein:

said first detector senses a position of said first piston within said chamber;

said second detector senses a position of said second piston within said chamber;

said first transducer occasionally exerts a force upon said first piston;

said second transducer occasionally exerts a force on said second piston; and the forces exerted on said first and second pistons tend to keep said first and second pistons synchronized.

13. The engine of claim 12, wherein:

said first transducer converts kinetic energy of said first piston into electrical energy; and said second transducer converts kinetic energy of said second piston into electrical energy.

14. The engine of claim 13, wherein:

said first transducer is an electromagnet; and said second transducer is an electromagnet.

15. The engine of claim 14, wherein:

said chamber is micromachined from a material; and said first and second pistons are micromachined from the material.

16. The engine of claim 15, wherein the material is from a group consisting of silicon, ceramic, sapphire, silicon carbide, Pyrex and metal.

17. The engine of claim 16, wherein:

said first and second pistons have first ends facing each other and permanent magnets attached to their second ends; and said first and second electromagnets are said first and second detectors, respectively.

18. A microcombustion engine comprising:

a chamber;

a first piston situated in said chamber and freely moveable along a length of said chamber;

a second piston situated in said chamber and freely moveable along the length of said chamber, wherein said first and second pistons are moveable towards each other so as to compress and ignite a fuel mixture into a combustion without a spark; and a vent situated in said chamber; and wherein said chamber, first piston, second piston, and vent are micromachined from a material.

19. The engine of claim 18, further comprising:

a first transducer situated at a first end of said chamber; and a second transducer situated at a second end of said chamber.

20. The engine of claim 19, further comprising a detector for sensing positions of said first and second pistons.

21. The engine of claim 20, wherein said first and second pistons are moveable in said chamber towards each other to compress and ignite a fuel mixture, which enters said chamber via said vent, into a combustion that forces said first and second pistons away from each other, resulting in a burnt fuel mixture to exit said chamber via said vent.

22. The engine of claim 21, wherein said first and second transducers convert movement of said first and second pistons into electrical energy.

23. The engine of claim 22, further comprising a circuit connected to said first and second detectors and to said first and second transducers.

24. The engine of claim 23, wherein said circuit receives signals from said detectors and outputs signals to said transducers which apply forces to said pistons to synchronize said first and second pistons' movements in said chamber.

25. The engine of claim 24, wherein said circuit receives electrical energy from said transducer for application to a load or storage.

26. The engine of claim 25, wherein said transducers are electromagnets.

27. The engine of claim 26, wherein said first and second transducers comprise said first and second detectors.

28. The engine of claim 27, further comprising:

a first permanent magnet attached to said first piston;

a second permanent magnet attached to said second piston; and wherein said first and second permanent magnets affect said first and second transducers, respectively.

29. The engine of claim 28, wherein the material is from a group consisting of silicon, ceramic, sapphire, silicon carbide, Pyrex and metal.

* * * * *